US008999077B2

(12) United States Patent
Ohtani et al.

(10) Patent No.: US 8,999,077 B2
(45) Date of Patent: Apr. 7, 2015

(54) CHEMICAL CONVERSION TREATMENT LIQUID, METHOD OF PRODUCING THE SAME, AND METHOD OF FORMING CONVERSION LAYER

(75) Inventors: Yusuke Ohtani, Kobe (JP); Megumi Sugioka, Kobe (JP); Takashi Hasegawa, Kobe (JP)

(73) Assignees: Murata Co., Ltd., Kobe-shi, Hyogo (JP); Morimura Bros., Inc., Tokyo (JP)

( * ) Notice: Subject to any disclaimer, the term of this patent is extended or adjusted under 35 U.S.C. 154(b) by 0 days.

(21) Appl. No.: 13/253,288

(22) Filed: Oct. 5, 2011

(65) Prior Publication Data

US 2012/0024428 A1 Feb. 2, 2012

Related U.S. Application Data

(63) Continuation of application No. PCT/JP2010/054253, filed on Mar. 12, 2010.

(30) Foreign Application Priority Data

Apr. 9, 2009 (JP) ..... 2009-095047
Mar. 10, 2010 (JP) ..... 2010-053217

(51) Int. Cl.
*C23C 22/48* (2006.01)
*C23C 22/53* (2006.01)

(52) U.S. Cl.
CPC ..... *C23C 22/53* (2013.01)

(58) Field of Classification Search
CPC ..... C23C 22/48
USPC ..... 148/247
See application file for complete search history.

(56) References Cited

FOREIGN PATENT DOCUMENTS

| | | | | |
|---|---|---|---|---|
| JP | 09-053192 | A | 2/1997 | |
| JP | 11-181578 | A | 7/1999 | |
| JP | 11-335863 | * | 12/1999 | ..... C23C 22/00 |
| JP | 11-335863 | A | 12/1999 | |
| JP | 11-335864 | A | 12/1999 | |
| JP | 2000-328271 | A | 11/2000 | |
| JP | 2002-327280 | A | 11/2002 | |
| JP | 2004-083771 | A | 3/2004 | |
| JP | 2007-9319 | A | 1/2007 | |
| JP | 2007-023353 | A | 2/2007 | |

(Continued)

OTHER PUBLICATIONS

International Search Report dated Apr. 6,2010 (in English) in counterpart International Application No. PCT/JP2010/054253.

(Continued)

*Primary Examiner* — Lois Zheng
(74) *Attorney, Agent, or Firm* — Holtz, Holtz, Goodman & Chick PC

(57) ABSTRACT

Provided is a chromium-free chemical conversion treatment technique that makes it possible to form a conversion layer excellent in corrosion resistance and appearance without using fluorine and hydrogen peroxide. The chemical conversion treatment liquid is for forming a conversion layer on zinc or zinc alloy and free of chromium, hydrogen peroxide and fluorine, includes 0.5 g/L to 38 g/L of magnesium, 0.5 g/L to 3.5 g/L of silicon, and 0.36 g/L or more of nitrate ion, contains the silicon as a water-soluble silicate, optionally further includes cobalt at a concentration of 5 g/L or less, and has an aluminum content of 0.08 g/L or less.

18 Claims, 1 Drawing Sheet

10.0 μm

(56) References Cited

FOREIGN PATENT DOCUMENTS

| | | | |
|---|---|---|---|
| JP | 2007-177304 | A | 7/2007 |
| JP | 2008-133502 | A | 6/2008 |
| JP | 2009-57587 | A | 3/2009 |

OTHER PUBLICATIONS

English-language International Preliminary Report on Patentability and Written Opinion of the International Searching Authority, dated Nov. 24, 2011 for International Application PCT/JP2010/054253 filed Mar. 12, 2010; Applicants: Murata Co., Ltd. et al.

* cited by examiner 10.0 μm 10.0 μm

CHEMICAL CONVERSION TREATMENT LIQUID, METHOD OF PRODUCING THE SAME, AND METHOD OF FORMING CONVERSION LAYER

CROSS-REFERENCE TO RELATED APPLICATIONS

This application is a Continuation Application of PCT Application No. PCT/JP2010/054253, filed Mar. 12, 2010 and based upon and claiming the benefit of priority from prior Japanese Patent Applications No. 2009-095047, filed Apr. 9, 2009; and No. 2010-053217, filed Mar. 10, 2010, the entire contents of all of which are incorporated herein by reference.

BACKGROUND OF THE INVENTION

1. Field of the Invention

The present invention relates to a chemical conversion treatment technique, and more specifically, to a chemical conversion treatment technique for forming a conversion layer on a surface of zinc or zinc alloy.

2. Description of the Related Art

A chromate treatment is a classical chemical conversion treatment for preventing a surface of zinc or zinc alloy from rust. The chromate treatment has been widely used in industry due to low cost and easy-to-use.

However, since hexavalent chromium is a hazardous substance, a restriction on its use is becoming more widespread. For this reason, studies on a chemical conversion treatment using trivalent chromium instead of hexavalent chromium and a chromium-free chemical conversion treatment are carried out vigorously.

For example, Jpn. Pat. Appln. KOKAI Publication No. 11-181578 describes a chemical conversion treatment liquid containing aluminum, silicon and one or more of organic acids or inorganic acids. This patent document also describes that addition of fluorine into the chemical conversion treatment liquid makes it possible to obtain an excellent appearance.

Jpn. Pat. Appln. KOKAI Publication No. 2007-177304 describes a chemical conversion treatment liquid containing at least one of a water-soluble inorganic salt of magnesium and a water-soluble inorganic salt of lithium; another water-soluble inorganic salt or a inorganic silicate or colloidal silica; and hydrogen peroxide. This patent document also describes that using the chemical conversion treatment liquid makes it possible to form a chromium-free layer having a sufficient corrosion resistance.

BRIEF SUMMARY OF THE INVENTION

Fluorine compounds are corrosive and liquid wastes containing them are difficult to treat. On the other hand, hydrogen peroxide needs careful handling and has low stability. Therefore, a chromium-free chemical conversion treatment technique that does not use fluorine and hydrogen peroxide is desired.

An object of the present invention is to provide a chromium-free chemical conversion treatment technique that makes it possible to form a conversion layer excellent in corrosion resistance and appearance without using fluorine and hydrogen peroxide.

According to a first aspect of the present invention, there is provided a chemical conversion treatment liquid for forming a conversion layer on zinc or zinc alloy, the liquid being free of chromium, hydrogen peroxide and fluorine and comprising 0.5 g/L to 38 g/L of magnesium, 0.5 g/L to 3.5 g/L of silicon, and 0.36 g/L or more of nitrate ion, the liquid containing the silicon as a water-soluble silicate and optionally further comprising cobalt at a concentration of 5 g/L or less, and aluminum content thereof being 0.08 g/L or less.

According to a second aspect of the present invention, there is provided a method of producing a chemical conversion treatment liquid, comprising mixing first and second concentrates and optionally water together to obtain the chemical conversion treatment liquid according to the first aspect, the first concentrate containing magnesium and nitrate ion at higher concentrations than those in the second concentrate, and the second concentrate containing water-soluble silicate at a higher concentration than that in the first concentrate.

According to a second aspect of the present invention, there is provided a method of forming a conversion layer, comprising subjecting zinc or zinc alloy to a chemical conversion treatment using the chemical conversion treatment liquid according to the first aspect.

DETAILED DESCRIPTION OF THE INVENTION

Figure 1:
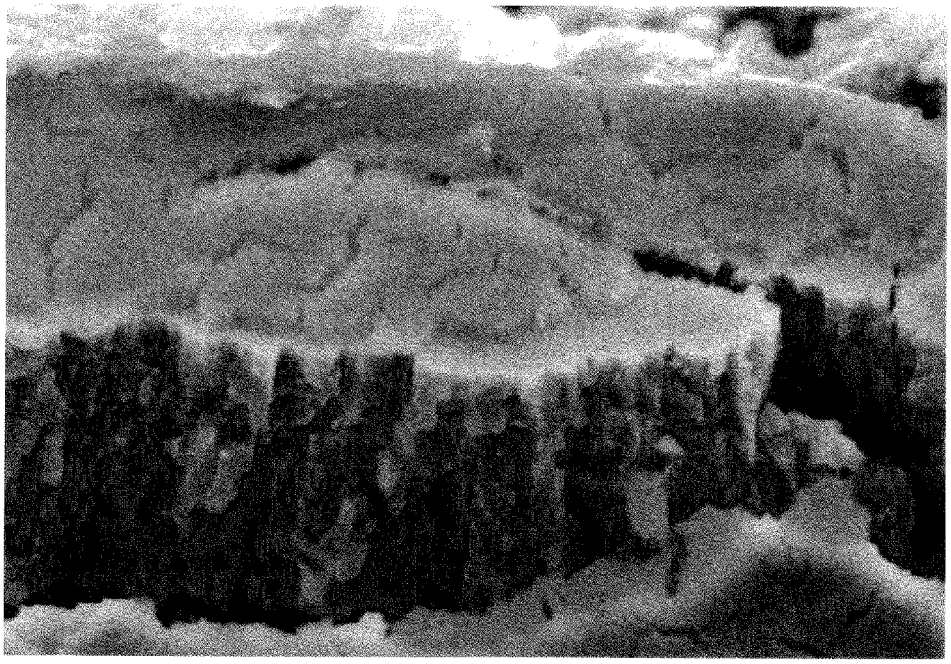
FIG. 1 is a microphotograph of a conversion layer.

Embodiments of the present invention will be described below.

First, a first embodiment of the present invention will be described.

The chemical conversion treatment liquid according to the first embodiment of the present invention is a chemical conversion treatment liquid for forming a conversion layer on zinc or zinc alloy. The chemical conversion treatment liquid is free of chromium, hydrogen peroxide and fluorine, and typically free of aluminum. The chemical conversion treatment liquid contains magnesium, cobalt, silicon, and nitrate ion in addition to an aqueous solvent such as water.

The chemical conversion treatment liquid contains magnesium as, for example, magnesium ion. The chemical conversion treatment liquid may contain magnesium as complex on or polyatomic ion or as their combinations with magnesium ion.

The magnesium concentration of the chemical conversion treatment liquid falls within a range of 1 g/L to 12 g/L, typically a range of 1.8 g/L to 5 g/L. Decreasing the magnesium concentration will degrade the corrosion resistance increasing the magnesium concentration will degrade the corrosion resistance and appearance.

The chemical conversion treatment liquid contains cobalt as, for example, cobalt ion. The chemical conversion treatment liquid may contain cobalt as complex ion or polyatomic ion or as their combinations with cobalt ion.

The cobalt concentration of the chemical conversion treatment liquid falls within a range of 0.03 g/L to 5 g/L, typically a range of 0.05 g/L to 2 g/L. Decreasing the cobalt concentration will degrade the corrosion resistance. Increasing the cobalt concentration will degrade the corrosion resistance and appearance. Note that in the case where the cobalt concentration is 0.03 g/L or more, even when the chemical conversion treatment liquid is left stand for a long period of time from the production to the use, gelation of the liquid will not occur. In particular, in the case where the cobalt concentration is 0.05 g/L or more, even when the chemical conversion treatment liquid is left stand for a long period of time from the production to the use, the viscosity of the liquid will not increase.

The chemical conversion treatment liquid contains silicon as water-soluble silicate. In the case where the chemical conversion treatment liquid contains silicon in a form other than water-soluble silicate, for example, as colloidal silica, it is impossible to achieve the excellent corrosion resistance and/or appearance achieved in the case where the chemical conversion treatment liquid contains silicon in a form of water-soluble silicate.

As the silicate, for example, a salt of an alkali metal such as sodium silicate or potassium silicate can be used. As the silicate, a single compound or a plurality of compounds may be used.

The silicon concentration the chemical conversion treatment liquid fails within a range of 0.7 g/L to 3.5 g/L, typically a range of 1.2 g/L to 3 g/L. Decreasing the silicon concentration will degrade the corrosion resistance. Increasing the silicon concentration will degrade the corrosion resistance and appearance.

The nitrate ion concentration of the chemical conversion treatment liquid falls within a range of 3 g/L to 15 g/L, typically a range of 4.5 g/L to 11 g/L. Decreasing or increasing the nitrate ion concentration will degrade the corrosion resistance.

Although the chemical conversion treatment liquid typically does not contain aluminum, the chemical conversion treatment liquid can contain aluminum at a concentration of 0.01 g/L or less. Increasing the aluminum concentration will degrade the corrosion resistance and appearance.

Typically, the chemical conversion treatment liquid contains only magnesium and cobalt as metal elements or contains only magnesium, cobalt and aluminum as metal elements. The chemical conversion treatment liquid may further contain metal elements other than chromium, magnesium, cobalt and aluminum. For example, the chemical conversion treatment liquid may further contain metal elements such as sodium, potassium and calcium. Note that the total amount of the additional metal elements is, for example, 10 g/L or less.

As far as a sufficient performance is achieved, the chemical conversion treatment liquid may further contain colloidal silica. In this case, the colloidal silica concentration of the chemical conversion treatment liquid is set such that the sum of the water-soluble silicate concentration converted into a silicon concentration and the colloidal silica concentration converted into a silicon concentration falls within, for example, the range of silicon concentration described for the water-soluble silicate.

The chemical conversion treatment liquid may contain only nitric acid as an acid or may further contain another inorganic acid in addition to nitric acid. As the additional inorganic acid, for example, sulfuric acid, hydrochloric acid or a combination thereof can be used. The concentration of the inorganic acid other than nitric acid in the chemical conversion treatment liquid is, for example, 10 g/L or less.

The chemical conversion treatment liquid is an acidic solution. The pH value of the chemical conversion treatment liquid falls within, for example, a range of 1.5 to 3.5, typically a range of 1.8 to 3.0.

When preparing the chemical conversion treatment liquid, for example, nitrates, sulfates, chlorides, or a combination of two or more of them can be used as the sources of the metal elements such as magnesium and cobalt. As the source of nitric ion, for example, nitric acid, nitrates of metals such as magnesium and cobalt, or a combination thereof can be used.

Formation of a conversion layer using this chemical conversion treatment liquid is performed, for example, by the following method.

First, prepared is a workpiece made of zinc or zinc alloy or a workpiece having a layer of zinc or zinc alloy on the surface thereof. As the workpiece having a layer of zinc or zinc alloy on the surface thereof, for example, a metal part having a plated layer of zinc or zinc alloy on the surface thereof is used.

Then, the surface of the workpiece made of zinc or zinc alloy is subjected to an activation treatment. The activation treatment includes, for example, bringing an aqueous solution of nitric acid into contact with the surface of the workpiece made of zinc or zinc alloy. For example, the workpiece is immersed into the aqueous solution of nitric acid.

After washing the activated workpiece with water, the workpiece is subjected to a chemical conversion treatment. That is, the above-described chemical conversion treatment liquid is brought into contact with the workpiece. For example, the workpiece is immersed into the chemical conversion treatment liquid. Here, the temperature of the chemical conversion treatment liquid is set within, for example, a range of 10° to 80° C., typically a range of 30° to 50° C. The duration during which the workpiece is in contact with the chemical conversion treatment liquid is, for example, 30 to 600 seconds, typically 60 to 180 seconds.

After washing the workpiece subjected to the chemical conversion treatment with water, the workpiece is subjected to a dry treatment. For example, the work piece is air-dried or dried by heating it at a temperature higher than the ambient temperature. The temperature for drying is, for example, 150° C. or lower.

As above, a conversion layer is formed on the surface of the workpiece.

This method does not use chromium, fluorine or hydrogen peroxide. Nevertheless, this method can form a conversion layer excellent in corrosion resistance and appearance.

In particular, according to this method, even in the case where the workpiece has a complicated shape, excellent corrosion resistance can be achieved. To be more specific, in the case where a workpiece has recesses and/or protrusions on the surface thereof as a bolt, excellent corrosion resistance is generally difficult to achieve at the edge portions. According to the above-described method, even in the case where the workpiece has recesses and/or protrusions on the surface thereof as a bolt, excellent corrosion resistance can be achieved.

Although described here is an organic acid-free chemical conversion treatment liquid and a method of forming a conversion layer using this liquid, the chemical conversion treatment liquid may contain an organic acid.

A treatment using a finishing agent may be performed after the above-described chemical conversion treatment. For example, the workplace may be immersed into a finishing solution after the washing by water subsequent to the chemical conversion treatment and before the dry treatment.

Next, a second embodiment of the present invention will be described.

In some cases, a chemical conversion treatment liquid is distributed in a form of two concentrates, a first concentrate free of silicon and a second concentrate containing silicon, and is prepared in situ by mixing them together and diluting it, if necessary. Since increasing the silicon concentration in the second concentrate will degrade its stability, the second concentrate should be prepared to have a low silicon concentration. For this reason, there is a possibility that the silicon concentration in the chemical conversion treatment liquid is limited to a low value.

The present inventors had changed the composition of the chemical conversion treatment liquid according to the first embodiment and studied the performances thereof. As a result, it was surprisingly found that when the silicon concentration is decreased, the allowable concentration ranges for the components other than silicon and cobalt are widened. The technique described below is based on this finding.

The chemical conversion treatment liquid according to the second embodiment of the present invention is a chemical conversion treatment liquid for forming a conversion layer on zinc or zinc alloy. The chemical conversion treatment liquid is free of chromium, hydrogen peroxide and fluorine, and typically free of aluminum. The chemical conversion treatment liquid contains magnesium, silicon, and nitrate ion in addition to an aqueous solvent such as water.

The chemical conversion treatment liquid contains magnesium as, for example, magnesium ion. The chemical conversion treatment liquid may contain magnesium as complex ion or polyatomic ion or as their combinations with magnesium ion.

The magnesium concentration of the chemical conversion treatment liquid falls within a range of 0.5 g/L to 38 g/L, typically a range of 2.5 g/L to 25 g/L. Decreasing the magnesium concentration will degrade the corrosion resistance. Increasing the magnesium concentration will degrade the corrosion resistance and appearance.

The chemical conversion treatment liquid contains silicon as water-soluble silicate. In the case where the chemical conversion treatment liquid contains silicon in a form other than water-soluble silicate, for example, as colloidal silica, it is impossible to achieve the excellent corrosion resistance and/or appearance achieved in the case where the chemical conversion treatment liquid contains silicon in a form of water-soluble silicate.

As the silicate, for example, a salt of an alkali metal such as sodium silicate or potassium silicate can be used. As the silicate, a single compound or a plurality of compounds may be used.

The silicon concentration of the chemical conversion treatment liquid falls within a range of 0.5 g/L to 2.5 g/L, typically a range of 1 g/L to 1.6 g/L. Decreasing the silicon concentration will degrade the corrosion resistance. Increasing the silicon concentration will degrade the corrosion resistance and appearance.

The nitrate ion concentration of the chemical conversion treatment liquid falls within a range of 0.36 g/L or more, typically a range of 1.82 g/L to 51.06 g/L. Decreasing the nitrate ion concentration will greatly degrade the corrosion resistance. Increasing the nitrate ion concentration will slightly degrade the corrosion resistance.

The chemical conversion treatment liquid may further contain cobalt. The chemical conversion treatment liquid may cobalt as cobalt ion. Alternatively, the chemical conversion treatment liquid may contain cobalt as complex ion or polyatomic ion or as their combinations with cobalt ion.

The cobalt concentration of the chemical conversion treatment liquid falls within a range of 3.25 g/L or less, typically a range of 0.05 g/L to 1.5 g/L. Decreasing the cobalt concentration will slightly degrade the corrosion resistance. Increasing the cobalt concentration will degrade the corrosion resistance and appearance.

Although the chemical conversion treatment liquid typically does not contain aluminum, the chemical conversion treatment liquid can contain aluminum at a concentration of 0.08 g/L or less. Increasing the aluminum concentration will degrade the corrosion resistance and appearance. The aluminum concentration in the chemical conversion treatment liquid is, for example, 0.03 g/L or less, typically 0.01 g/L or less.

Typically, the chemical conversion treatment liquid contains only magnesium and cobalt as metal elements or contains only magnesium, cobalt and aluminum as metal elements. The chemical conversion treatment liquid may further contain metal elements other than chromium, magnesium, cobalt and aluminum. For example, the chemical conversion treatment liquid may further contain metal elements such as sodium, potassium and calcium.

As far as a sufficient performance is achieved, the chemical conversion treatment liquid may further contain colloidal silica. In this case, the colloidal silica concentration of the chemical conversion treatment liquid is set such that the sum of the water-soluble silicate concentration converted into a silicon concentration and the colloidal silica concentration converted into a silicon concentration falls within, for example, the range of silicon concentration described for the water-soluble silicate.

The chemical conversion treatment liquid may contain only nitric acid as an acid or may further contain another inorganic acid in addition to nitric acid. As the additional inorganic acid, for example, sulfuric acid, hydrochloric acid or a combination thereof can be used. The concentration of the inorganic acid other than nitric acid in the chemical conversion treatment liquid is, for example, 10/L or less.

The chemical conversion treatment liquid is an acidic solution. The pH value of the chemical conversion treatment liquid falls within, for example, a range of 1.0 to 5.0, typically a range of 1.5 to 3.0.

When preparing the chemical conversion treatment liquid, for example, nitrates, sulfates, chlorides, or a combination of two or more of them can be used as the sources of the metal elements such as magnesium and cobalt. As the source of nitric ion, for example, nitric acid, nitrates of metals such as magnesium and cobalt, or a combination thereof can be used.

The chemical conversion treatment liquid can be produced by, for example, the following method.

First, the first and second concentrates are prepared.

The first concentrate contains magnesium. The magnesium concentration in the first concentrate is higher than the magnesium concentration in the chemical conversion treatment liquid. A ratio $M_{Mg}1/M_{Mg}C$ of the magnesium concentration $M_{Mg}1$ in the first concentrate to the magnesium concentration $M_{Mg}C$ in the chemical conversion treatment liquid falls within, for example, a range of 1.0 to 672.0, typically a range of 2.0 to 134.0.

The first concentrate further contains nitric ion. The nitric ion concentration in the first concentrate is higher than the nitric ion concentration in the chemical conversion treatment liquid.

Typically, the first concentrate is free of silicon. The first concentrate may further contain a small amount of silicon in a form of water-soluble silicate. Note that the silicon concentration in the first concentrate should be set at a value lower than the silicon concentration in the second concentrate.

The pH value of the first concentrate falls within, for example, a range of 0.5 to 3.0, typically a range of 1.0 to 2.0. The first concentrate having a high pH value cannot be produced stably. In the case where the first concentrate has a low pH value, an alkali needs to be added to the chemical conversion treatment liquid in order to achieve an optimum pH the chemical conversion treatment liquid, and thus the production of the chemical conversion treatment liquid will require a lot of time and effort.

The second concentrate contains silicon in a form of water-soluble silicate. The silicon concentration in the second concentrate is higher than the silicon concentration in the chemical conversion treatment liquid. A ratio $M_{Si}2/M_{Si}C$ of the silicon concentration $M_{Si}2$ in the second concentrate to the silicon concentration $M_{Si}C$ in the chemical conversion treatment liquid falls within, for example, a range of 1.0 to 18.0, typically a range of 2.0 to 9.0.

The second concentrate can further contain cobalt. In the case where the second concentrate contains cobalt, the cobalt concentration the second concentrate is higher than the cobalt concentration in the chemical conversion treatment liquid.

The pH value of the second concentrate falls within, for example, a range of 0.5 to 3.0, typically a range of 1.0 to 2.0. The second concentrate having a high pH value has a tendency of low stability. In the case where the second concentrate has a low pH value, an alkali needs to be added to the chemical conversion treatment liquid in order to achieve an optimum pH value in the chemical conversion treatment liquid, and thus the production of the chemical conversion treatment liquid will require a lot of time and effort.

Then, the first and second concentrates are mixed together. Thus, the chemical conversion treatment liquid is obtained.

At least one of the first and second concentrates may be diluted with water prior to be mixed together. Alternatively, after mixing the first and second concentrates, the mixture may be diluted with water. Alternatively, it is possible that the first and second concentrates and the mixed liquid are not diluted with water.

As described above, the first concentrate does not contain silicon or contains silicon at a low concentration. Therefore, the first concentrate is excellent in stability. On the other hand, the silicon concentration in the second concentrate is relatively low. Thus, the second concentrate is excellent in stability, too. Therefore, the first and second concentrates can be stored for a long period of time.

Although described here is a production of a chemical conversion treatment liquid using the first and second concentrates, the chemical conversion treatment liquid may be produced by diluting a single concentrate. For example, the chemical conversion treatment liquid may be produced by diluting a concentrate containing all the components described for the chemical conversion treatment liquid with water.

Formation of a conversion layer using this chemical conversion treatment liquid is performed, for example, by the following method.

First, prepared is a workpiece made of zinc or zinc alloy or a workpiece having a layer of zinc or zinc alloy on the surface thereof. As the workpiece having a layer of zinc or zinc alloy on the surface thereof, for example, a metal part having a plated layer of zinc or zinc alloy on the surface thereof is used.

Then, the surface of the workpiece made of zinc or zinc alloy is subjected to an activation treatment. The activation treatment includes, for example, bringing an aqueous solution of nitric acid into contact with the surface of the workpiece made of zinc or zinc alloy. For example, the workpiece is immersed into the aqueous solution of nitric acid.

After washing the activated workpiece with water, the workpiece is subjected to a chemical conversion treatment. That is, the above-described chemical conversion treatment liquid is brought into contact with the workpiece. For example, the workpiece is immersed into the chemical conversion treatment liquid. Here, the temperature of the chemical conversion treatment liquid is set within, for example, a range of 10° to 80° C., typically a range of 30° to 50° C. The duration during which the workpiece is in contact with the chemical conversion treatment liquid is, for example, 30 to 600 seconds, typically 60 to 180 seconds.

After washing the workpiece subjected to the chemical conversion treatment with water, the workpiece is subjected to a dry treatment for example, the work piece is air-dried or dried by heating it at temperature higher than the ambient temperature. The temperature for drying is, for example, 150° C. or lower.

As above, a conversion layer is formed on the surface of the workpiece.

This method does not use chromium, fluorine or hydrogen peroxide. Nevertheless, this method can form a conversion layer excellent in corrosion resistance and appearance.

In particular, according to this method, even in the case where the workpiece has a complicated shape, excellent corrosion resistance can be achieved. To be more specific, in the case where a workpiece has recesses and/or protrusions on the surface thereof as a bolt, excellent corrosion resistance is generally difficult to achieve at the edge portions. According to the above-described method, even in the case where the workpiece has recesses and/or protrusions on the surface thereof as a bolt, excellent corrosion resistance can be achieved.

The chemical conversion treatment liquid used herein has a low silicon concentration. Therefore, the silicon concentration in the concentrate to be used in the production of the chemical conversion treatment liquid can be set at a relatively low value. A concentrate having a low silicon concentration is less prone to cause gelation even in the case of storing for a long period of time.

As described above, the chemical conversion treatment liquid used herein has wide allowable concentration ranges for the components other than silicon and cobalt. A wide allowable nitric ion concentration range is advantageous, for example, in the following respect.

In the above-described method, the workpiece is subjected to the activation treatment using an aqueous nitric acid solution and the water-washing prior to bringing the chemical conversion treatment liquid into contact with the workpiece. In the case where the activation treatment, water-washing and chemical conversion treatment are performed in an activation treatment tank containing an aqueous nitric acid solution, a water-washing bat containing water, and a chemical conversion treatment tank containing the chemical conversion treatment liquid, respectively, the water in the water-washing tank will be contaminated with a part of the aqueous nitric acid solution in the activation treatment tank, and the chemical conversion treatment liquid in the chemical conversion treatment tank will be contaminated with the water in the water-washing tank that is contaminated with nitric acid. For this reason, when the treatments are repeated, the nitric acid concentration in the chemical conversion treatment liquid will increase.

In the case where the water in the water-washing tank is changed frequently or the water-washing tank is supplied with a flow of water all the time, the increase in nitric ion concentration in the chemical conversion treatment liquid can be suppressed. To perform this, however, an additional cost of equipment may be necessary or the running cost may increase.

In the case where the allowable nitric ion concentration range is wide, the increase in the nitric ion concentration in the chemical conversion treatment liquid has a small effect on the performance of the conversion layer. Therefore, conversion layers having excellent performance can be manufactured for a long period of time without frequently changing the water in the water-washing tank.

In the chemical conversion treatment liquid used herein, cobalt is an optional component. Nickel, chromium, cobalt, etc. are examples of metals those are prone to cause a metal allergy. Cobalt is a metal having a small load on the environmental as compared with nickel, etc., and its use is scarcely restricted at the present. In Europe in which awareness of environmental pollution is high, however, efforts to decrease an amount of cobalt usage are undertaken. Disuse of cobalt or a low cobalt concentration is also advantageous in this respect.

Although described here is an organic acid-free chemical conversion treatment liquid and a method of forming a conversion layer using this liquid, the chemical conversion treatment liquid may contain an organic acid.

A treatment using a finishing agent may be performed after the above-described chemical conversion treatment. For example, the workpiece may be immersed into a finishing solution after the washing by water subsequent to the chemical conversion treatment and before the dry treatment.

The techniques according to the first and second embodiments can be combined with each other. For example, the chemical conversion treatment liquid according to the first embodiment may be produced by the method described in the second embodiment.

Examples of the present invention will be described below.

<Test 1>

In this test, an influence of magnesium concentration in a chemical conversion treatment liquid on the appearance and corrosion resistance of a conversion layer was investigated.

First, steel parts were galvanized. As the steel parts, used were M8 bolts each having an overall length of 50 mm and a thread length of 25 mm. As the plating bath, a zincate bath (Non Cyanide Alkaline Zinc Plating Process SurTec 704) was used. For the galvanization, a barrel process was utilized. Thicknesses of the plated layers were set within a range of 10 μm to 12 μm. Hereinafter, the steel part subjected to the galvanization will be referred to as "galvanized part".

Then, the parts were sufficiently washed with water and subsequently subjected to an activation treatment. The activation treatment included immersing the galvanized parts into 1% aqueous nitric acid solution. Further, the parts were sufficiently washed with water and then subjected to chemical conversion treatments using chemical conversion treatment liquids 1A to 1T. TABLE 1 below shows the compositions of the treatment liquids 1A to 1T.

The treatment liquids 1A to 1T were prepared by mixing magnesium chloride hexahydrate, cobalt chloride hexahydrate, sodium metasilicate anhydride, sodium nitrate and pure water together. The chemical conversion treatments were performed with the treatment temperature and the immersion time set at 40° C. and 120 seconds, respectively. The pH values treatment liquids 1A to 1T were adjusted at about 2.0 using sulfuric acid.

After completing the chemical conversion treatments, the galvanized parts were washed with water and dried at 100° C. for 5 minutes. Thus, conversion layers were formed on the surfaces of the galvanized parts.

Next, appearances of the conversion layers thus obtained were evaluated. To be more specific, performed were an evaluation regarding gloss and iridescence and an evaluation regarding a degree of blooming. Regarding gloss and iridescence, a layer evenly exhibiting gloss and iridescence over the entire surface thereof was evaluated as "○" layer slightly tarnished or exhibiting a certain extent of unevenness in iridescence was evaluated as "Δ", and a layer tarnished in many regions or exhibiting serious unevenness in iridescence was evaluated as "X". Some results of the evaluations are summarized in TABLE 1 above.

Then, corrosion resistance of the galvanized parts after the surface treatments was evaluated according to a method of salt spray testing prescribed in JIS Z2371 (2000). An area ratio of a corrosion product appeared on the galvanized part to the total area of the part (referred to as corrosion product ratio) was measured on each part when the salt spray testing was continued for 50 hours.

The result was evaluated as "A" when no corrosion product appeared; as "B" when the corrosion product ratio was more than 0% and equal to or less than 5%; as "C" when the corrosion product ratio was more than 5% and equal to or less than 10%; as "D" when the corrosion product ratio was more than 10% and equal to or less than 50%; and as "E" when the corrosion product ratio was more than 50%. The results of evaluation are summarized in TABLE 1 above.

As shown in TABLE 1, in the case where the magnesium concentration was 16 g/L or less, sufficient performances were achieved regarding gross and iridescence. In the case where the magnesium concentration was 15 g/L or less, excellent performances were achieved regarding gross and

TABLE 1

| | Chemical conversion treatment liquid | | | | | | | | | |
|---|---|---|---|---|---|---|---|---|---|---|
| | 1A | 1B | 1C | 1D | 1E | 1F | 1G | 1H | 1I | 1J |
| Mg conc. (g/L) | 0.00 | 0.05 | 0.08 | 0.10 | 1.00 | 1.50 | 1.80 | 2.00 | 3.00 | 4.00 |
| Co conc. (g/L) | 1.0 | 1.0 | 1.0 | 1.0 | 1.0 | 1.0 | 1.0 | 1.0 | 1.0 | 1.0 |
| Si conc. (g/L) | 2.8 | 2.8 | 2.8 | 2.8 | 2.8 | 2.8 | 2.8 | 2.8 | 2.8 | 2.8 |
| $NO_3^-$ conc. (g/L) | 6.2 | 6.2 | 6.2 | 6.2 | 6.2 | 6.2 | 6.2 | 6.2 | 6.2 | 6.2 |
| Gross/iridescence | ○ | ○ | ○ | ○ | ○ | ○ | ○ | ○ | ○ | ○ |
| Corrosion resistance | E | E | D | D | C | C | B | A | A | B |

| | Chemical conversion treatment liquid | | | | | | | | | |
|---|---|---|---|---|---|---|---|---|---|---|
| | 1K | 1L | 1M | 1N | 1O | 1P | 1Q | 1R | 1S | 1T |
| Mg conc. (g/L) | 5.00 | 6.00 | 7.00 | 9.00 | 10.00 | 12.00 | 15.00 | 16.00 | 17.00 | 18.00 |
| Co conc. (g/L) | 1.0 | 1.0 | 1.0 | 1.0 | 1.0 | 1.0 | 1.0 | 1.0 | 1.0 | 1.0 |
| Si conc. (g/L) | 2.8 | 2.8 | 2.8 | 2.8 | 2.8 | 2.8 | 2.8 | 2.8 | 2.8 | 2.8 |
| $NO_3^-$ conc. (g/L) | 6.2 | 6.2 | 6.2 | 6.2 | 6.2 | 6.2 | 6.2 | 6.2 | 6.2 | 6.2 |
| Gross/iridescence | ○ | ○ | ○ | ○ | ○ | ○ | ○ | Δ | X | X |
| Corrosion resistance | B | C | C | C | C | C | D | D | E | E |

iridescence. Regarding blooming, an excellent performance was achieved regardless of the magnesium concentration.

In addition, as shown in TABLE 1 above, in the case where the magnesium concentration fell within a range of 1 g/L to 12 g/L, a sufficient corrosion resistance was achieved. In the case where the magnesium concentration fell within a range of 1.8 g/L to 5 g/L, an excellent corrosion resistance was achieved.

<Test 2>

In this test, an influence of cobalt concentration in a chemical conversion treatment liquid on the appearance and corrosion resistance of a conversion layer was investigated.

First, conversion layers were formed on surfaces of galvanized parts by the same method as that described in Test 1 except that chemical conversion treatment liquids 2A to 2R were used instead of the chemical conversion treatment liquids 1A to 1T. Then, appearance and corrosion resistance of each conversion layer thus obtained were evaluated by the same method as that described in Test 1. The compositions of the treatment liquids 2A to 2R and the results of evaluations are shown in TABLE 2 below.

TABLE 2

| | Chemical conversion treatment liquid | | | | | | | | |
|---|---|---|---|---|---|---|---|---|---|
| | 2A | 2B | 2C | 2D | 2E | 2F | 2G | 2H | 2I |
| Mg conc. (g/L) | 2.0 | 2.0 | 2.0 | 2.0 | 2.0 | 2.0 | 2.0 | 2.0 | 2.0 |
| Co conc. (g/L) | 0.00 | 0.01 | 0.03 | 0.05 | 0.08 | 0.10 | 0.20 | 0.50 | 0.80 |
| Si conc. (g/L) | 2.8 | 2.8 | 2.8 | 2.8 | 2.8 | 2.8 | 2.8 | 2.8 | 2.8 |
| $NO_3^-$ conc. (g/L) | 6.2 | 6.2 | 6.2 | 6.2 | 6.2 | 6.2 | 6.2 | 6.2 | 6.2 |
| Gross/iridescence | ○ | ○ | ○ | ○ | ○ | ○ | ○ | ○ | ○ |
| Corrosion resistance | D | D | C | B | B | B | B | B | B |

| | Chemical conversion treatment liquid | | | | | | | | |
|---|---|---|---|---|---|---|---|---|---|
| | 2J | 2K | 2L | 2M | 2N | 2O | 2P | 2Q | 2R |
| Mg conc. (g/L) | 2.0 | 2.0 | 2.0 | 2.0 | 2.0 | 2.0 | 2.0 | 2.0 | 2.0 |
| Co conc. (g/L) | 1.00 | 2.00 | 2.50 | 3.00 | 4.00 | 5.00 | 5.50 | 6.00 | 7.00 |
| Si conc. (g/L) | 2.8 | 2.8 | 2.8 | 2.8 | 2.8 | 2.8 | 2.8 | 2.8 | 2.8 |
| $NO_3^-$ conc. (g/L) | 6.2 | 6.2 | 6.2 | 6.2 | 6.2 | 6.2 | 6.2 | 6.2 | 6.2 |
| Gross/iridescence | ○ | ○ | ○ | Δ | Δ | Δ | Δ | Δ | X |
| Corrosion resistance | A | B | C | C | C | C | D | E | E |

As shown in TABLE 2 above, in the case where the cobalt concentration was 6 g/L or less, sufficient performances were achieved regarding gross and iridescence. In the case where the cobalt concentration 2.5 g/L or less, excellent performances were achieved regarding gross and iridescence. Regarding blooming, an excellent performance was achieved regardless of the cobalt concentration.

In addition, as shown in TABLE 2 above, in the case where the cobalt concentration fell within a range of 0.03 q/L to 5 g/L, a sufficient corrosion resistance was achieved. In the case where the cobalt concentration fell within a range of 0.05 g/L to 2 g/L, an excellent corrosion resistance was achieved.

<Test 3>

In this test, an influence of silicon concentration in a chemical conversion treatment liquid on the appearance and corrosion resistance of a conversion layer was investigated.

First, conversion layers were formed on surfaces of galvanized parts by the same method as that described in Test 1 except that chemical conversion treatment liquids 3A to 3R were used instead of the chemical conversion treatment liquids 1A to 1T. Then, appearance and corrosion resistance of each conversion layer thus obtained were evaluated by the same method as that described in Test 1, The compositions of the treatment liquids 3A to 3R and the results of evaluations are shown in TABLE 3 below.

TABLE 3

| | Chemical conversion treatment liquid | | | | | | | | |
|---|---|---|---|---|---|---|---|---|---|
| | 3A | 3B | 3C | 3D | 3E | 3F | 3G | 3H | 3I |
| Mg conc. (g/L) | 2.0 | 2.0 | 2.0 | 2.0 | 2.0 | 2.0 | 2.0 | 2.0 | 2.0 |
| Co conc. (g/L) | 1.0 | 1.0 | 1.0 | 1.0 | 1.0 | 1.0 | 1.0 | 1.0 | 1.0 |
| Si conc. (g/L) | 0.0 | 0.2 | 0.3 | 0.5 | 0.6 | 0.7 | 0.8 | 1.0 | 1.2 |
| $NO_3^-$ conc. (g/L) | 6.2 | 6.2 | 6.2 | 6.2 | 6.2 | 6.2 | 6.2 | 6.2 | 6.2 |
| Gross/iridescence | ○ | ○ | ○ | ○ | ○ | ○ | ○ | ○ | ○ |
| Corrosion resistance | E | E | E | D | D | C | C | C | B |

| | Chemical conversion treatment liquid | | | | | | | | |
|---|---|---|---|---|---|---|---|---|---|
| | 3J | 3K | 3L | 3M | 3N | 3O | 3P | 3Q | 3R |
| Mg conc. (g/L) | 2.0 | 2.0 | 2.0 | 2.0 | 2.0 | 2.0 | 2.0 | 2.0 | 2.0 |
| Co conc. (g/L) | 1.0 | 1.0 | 1.0 | 1.0 | 1.0 | 1.0 | 1.0 | 1.0 | 1.0 |

TABLE 3-continued

| | | | | | | | | | |
|---|---|---|---|---|---|---|---|---|---|
| Si conc. (g/L) | 1.4 | 2.0 | 2.4 | 2.8 | 3.0 | 3.5 | 4.0 | 4.5 | 5.0 |
| $NO_3^-$ conc. (g/L) | 6.2 | 6.2 | 6.2 | 6.2 | 6.2 | 6.2 | 6.2 | 6.2 | 6.2 |
| Gross/iridescence | ○ | ○ | ○ | ○ | ○ | Δ | Δ | Δ | X |
| Corrosion resistance | A | A | A | A | B | C | D | E | E |

As shown in TABLE 3 above, in the case where the silicon concentration was 4.5 g/L or less, sufficient performances were achieved regarding gross and iridescence. In the case where the silicon concentration was 3 g/L or less, excellent performances were achieved regarding gross and iridescence. Regarding blooming, an excellent performance was achieved regardless of the silicon concentration.

In addition, as shown in TABLE 3 above, in the case where the silicon concentration fell within a range of 0.7 g/L to 3.5 g/L, a sufficient corrosion resistance was achieved. In the case where the silicon concentration fell within a range of 1.2 g/L to 3 g/L, an excellent corrosion resistance was achieved.

<Test 4>

In this test, an influence of nitrate ion concentration in a chemical conversion treatment liquid on the appearance and corrosion resistance conversion layer was investigated.

First, conversion layers were formed on surfaces of galvanized parts by the same method as that described in Test 1 except that chemical conversion treatment liquids 4A to 4P were used instead of the chemical conversion treatment liquids 1A to 1T. Then, appearance and corrosion resistance of each conversion layer thus obtained were evaluated by the same method as that described in Test 1. The compositions of the treatment liquids 4A to 4P and the results of evaluations are shown in TABLE 4 below.

TABLE 4

| | Chemical conversion treatment liquid | | | | | | | |
|---|---|---|---|---|---|---|---|---|
| | 4A | 4B | 4C | 4D | 4E | 4F | 4G | 4H |
| Mg conc. (g/L) | 2.0 | 2.0 | 2.0 | 2.0 | 2.0 | 2.0 | 2.0 | 2.0 |
| Co conc. (g/L) | 1.0 | 1.0 | 1.0 | 1.0 | 1.0 | 1.0 | 1.0 | 1.0 |
| Si conc. (g/L) | 2.8 | 2.8 | 2.8 | 2.8 | 2.8 | 2.8 | 2.8 | 2.8 |
| $NO_3^-$ conc. (g/L) | 0.0 | 1.0 | 2.0 | 3.0 | 4.0 | 4.5 | 5.0 | 6.2 |
| Gross/iridescence | ○ | ○ | ○ | ○ | ○ | ○ | ○ | ○ |
| Corrosion resistance | E | E | D | C | C | B | A | A |

| | Chemical conversion treatment liquid | | | | | | | |
|---|---|---|---|---|---|---|---|---|
| | 4I | 4J | 4K | 4L | 4M | 4N | 4O | 4P |
| Mg conc. (g/L) | 2.0 | 2.0 | 2.0 | 2.0 | 2.0 | 2.0 | 2.0 | 2.0 |
| Co conc. (g/L) | 1.0 | 1.0 | 1.0 | 1.0 | 1.0 | 1.0 | 1.0 | 1.0 |
| Si conc. (g/L) | 2.8 | 2.8 | 2.8 | 2.8 | 2.8 | 2.8 | 2.8 | 2.8 |
| $NO_3^-$ conc. (g/L) | 8.0 | 10.0 | 11.0 | 12.0 | 15.0 | 18.0 | 20.0 | 24.0 |
| Gross/iridescence | ○ | ○ | ○ | ○ | ○ | ○ | ○ | ○ |
| Corrosion resistance | B | B | B | C | C | D | E | E |

As shown in TABLE 4 above, regardless of the nitrate ion concentration, sufficient performances were achieved regarding gross and iridescence. Regarding blooming, an excellent performance was also achieved regardless of the nitrate ion concentration.

In addition, as shown in TABLE 4 above, in the case where the nitrate ion concentration fell within a range of 3 g/L to 15 g/L, a sufficient corrosion resistance was achieved. In the case where the silicon concentration fell within a range of 4.5 g/L to 11 g/L, an excellent corrosion resistance was achieved.

<Test 5>

In this test, an influence of aluminum concentration in a chemical conversion treatment liquid on the appearance and corrosion resistance of a conversion layer was investigated.

First, conversion layers were formed on surfaces of galvanized parts by the same method as that described in Test 1 except that chemical conversion treatment liquids 5A to 5N were used instead of the chemical conversion treatment liquids 1A to 1T. Note that each of the chemical conversion treatment liquids 5A to 5N contains aluminum as shown in TABLE 5 below. Here, aluminum nitrate nonahydrate was used as the aluminum source.

Then, appearance and corrosion resistance of each conversion layer thus obtained were evaluated by the same method as that described in Test 1. Regarding blooming, the result was evaluated as "○" when no bloom product appeared on the surface, as "Δ" when an area ratio of bloom appeared on the galvanized part to the total area of the part was more than 0% and equal to or less than 50%, and as "X" when the area ratio was more than 50%.

The compositions of the treatment liquids 5A to 5N and the results of evaluations are shown in TABLE 5 below.

TABLE 5

| | Chemical conversion treatment liquid | | | | | | |
|---|---|---|---|---|---|---|---|
| | 5A | 5B | 5C | 5D | 5E | 5F | 5G |
| Mg conc. (g/L) | 2.0 | 2.0 | 2.0 | 2.0 | 2.0 | 2.0 | 2.0 |
| Co conc. (g/L) | 1.0 | 1.0 | 1.0 | 1.0 | 1.0 | 1.0 | 1.0 |
| Si conc. (g/L) | 2.8 | 2.8 | 2.8 | 2.8 | 2.8 | 2.8 | 2.8 |
| $NO_3^-$ conc. (g/L) | 6.2 | 6.2 | 6.2 | 6.2 | 6.2 | 6.2 | 6.2 |
| Al conc. (g/L) | 0.01 | 0.05 | 0.10 | 0.20 | 0.40 | 0.50 | 1.00 |
| Gross/iridescence | ○ | Δ | Δ | Δ | X | X | X |
| Blooming | ○ | ○ | ○ | Δ | X | X | X |
| Corrosion resistance | C | D | D | E | E | E | E |

| | Chemical conversion treatment liquid | | | | | | |
|---|---|---|---|---|---|---|---|
| | 5H | 5I | 5J | 5K | 5L | 5M | 5N |
| Mg conc. (g/L) | 2.0 | 2.0 | 2.0 | 2.0 | 2.0 | 2.0 | 2.0 |
| Co conc. (g/L) | 1.0 | 1.0 | 1.0 | 1.0 | 1.0 | 1.0 | 1.0 |
| Si conc. (g/L) | 2.8 | 2.8 | 2.8 | 2.8 | 2.8 | 2.8 | 2.8 |
| $NO_3^-$ conc. (g/L) | 6.2 | 6.2 | 6.2 | 6.2 | 6.2 | 6.2 | 6.2 |
| Al conc. (g/L) | 1.60 | 1.90 | 2.00 | 2.50 | 3.00 | 3.40 | 5.00 |
| Gross/iridescence | X | X | X | X | X | X | X |
| Blooming | X | X | X | X | X | X | X |
| Corrosion resistance | E | E | E | E | E | E | E |

As shown in TABLE 5 above, in the case where the aluminum concentration was 0.05 g/L or more, sufficient performances were not achieved regarding gross, iridescence and corrosion resistance. In the case where the aluminum concentration was 0.20 g/L or more, bloom appeared.

<Test 6>

In this test, an influence of a variety of metal elements in a chemical conversion treatment liquid on the appearance and corrosion resistance of a conversion layer was investigated.

First, conversion layers were formed on surfaces of galvanized parts by the same method as that described in Test 1 except that chemical conversion treatment liquids 6A to 6E were used instead of the chemical conversion treatment liquids 1A to 1T. Note that each of the chemical conversion treatment liquids 6A to 6E contains another metal element instead of magnesium as shown in TABLE 6 below. In preparing the chemical conversion treatment liquids 6A to 6e, sodium molybdate, sodium tungstate, potassium hexafluorozirconate, aluminum nitrate and titanium chloride were used as the metal sources instead of the magnesium source, respectively.

Then, appearance and corrosion resistance of each conversion layer thus obtained were evaluated by the same method as that described in Test 1. The compositions of the treatment liquids 6A to 6E and the results of evaluations are shown in TABLE 6 below.

TABLE 6

| | Chemical conversion treatment liquid | | | | |
|---|---|---|---|---|---|
| | 6A | 6B | 6C | 6D | 6E |
| Mo conc. (g/L) | 2.0 | 0.0 | 0.0 | 0.0 | 0.0 |
| W conc. (g/L) | 0.0 | 2.0 | 0.0 | 0.0 | 0.0 |
| Zr conc. (g/L) | 0.0 | 0.0 | 2.0 | 0.0 | 0.0 |
| Al conc. (g/L) | 0.0 | 0.0 | 0.0 | 2.0 | 0.0 |
| Ti conc. (g/L) | 0.0 | 0.0 | 0.0 | 0.0 | 2.0 |
| Co conc. (g/L) | 1.0 | 1.0 | 1.0 | 1.0 | 1.0 |
| Si conc. (g/L) | 2.8 | 2.8 | 2.8 | 2.8 | 2.8 |
| $NO_3^-$ conc. (g/L) | 6.2 | 6.2 | 6.2 | 6.2 | 6.2 |
| Gross/iridescence | ○ | Δ | ○ | X | ○ |
| Corrosion resistance | E | E | D | E | D |

In the case where magnesium was substituted with molybdenum, zirconium or titanium, sufficient performances were achieved regarding gross and iridescence as shown in TABLE 6 above, and a sufficient performance was also achieved regarding blooming. In this case, however, a sufficient performance was not achieved regarding corrosion resistance.

In the case where magnesium was substituted with tungsten or aluminum, sufficient performances were not achieved regarding gross, iridescence and corrosion resistance as shown in TABLE 6 above. Further, in this case, a sufficient performance was also not achieved regarding blooming.

<Test 7>

In this test, an influence of cobalt concentration in a chemical conversion treatment liquid on the stability of a conversion layer was investigated.

First, chemical conversion treatment liquids 7A to 7V were prepared by the same method as that described for the chemical conversion treatment liquids 1A to 1T except that the compositions were changed as shown in TABLE 7 below.

TABLE 7

| | Chemical conversion treatment liquid | | | | | | | | | | |
|---|---|---|---|---|---|---|---|---|---|---|---|
| | 7A | 7B | 7C | 7D | 7E | 7F | 7G | 7H | 7I | 7J | 7K |
| Mg conc. (g/L) | 2.0 | 2.0 | 2.0 | 2.0 | 2.0 | 2.0 | 2.0 | 2.0 | 2.0 | 2.0 | 2.0 |
| Co conc. (g/L) | 0.000 | 0.025 | 0.030 | 0.040 | 0.050 | 0.075 | 0.100 | 0.500 | 1.000 | 2.000 | 2.500 |
| Si conc. (g/L) | 2.8 | 2.8 | 2.8 | 2.8 | 2.8 | 2.8 | 2.8 | 2.8 | 2.8 | 2.8 | 2.8 |
| $NO_3^-$ conc. (g/L) | 6.2 | 6.2 | 6.2 | 6.2 | 6.2 | 6.2 | 6.2 | 6.2 | 6.2 | 6.2 | 6.2 |
| Stability | X | X | Δ | Δ | ○ | ○ | ○ | ○ | ○ | ○ | ○ |

| | Chemical conversion treatment liquid | | | | | | | | | | |
|---|---|---|---|---|---|---|---|---|---|---|---|
| | 7L | 7M | 7N | 7O | 7P | 7Q | 7R | 7S | 7T | 7U | 7V |
| Mg conc. (g/L) | 2.0 | 2.0 | 2.0 | 2.0 | 2.0 | 2.0 | 2.0 | 2.0 | 2.0 | 2.0 | 2.0 |
| Co conc. (g/L) | 3.000 | 4.000 | 5.000 | 5.500 | 6.000 | 7.000 | 8.000 | 9.000 | 10.000 | 15.000 | 20.000 |
| Si conc. (g/L) | 2.8 | 2.8 | 2.8 | 2.8 | 2.8 | 2.8 | 2.8 | 2.8 | 2.8 | 2.8 | 2.8 |
| $NO_3^-$ conc. (g/L) | 6.2 | 6.2 | 6.2 | 6.2 | 6.2 | 6.2 | 6.2 | 6.2 | 6.2 | 6.2 | 6.2 |
| Stability | ○ | ○ | ○ | ○ | ○ | ○ | ○ | ○ | ○ | ○ | ○ |

Then, the treatment liquids 7A to 7V were left stand at an ambient temperature for 4 months. Note that the pH values of the treatment liquids 7A to 7V after the passage of 4 months were within a range of 2.1 to 2.5.

Then, an extent of gelation was checked on each of the treatment liquids 7A to 7Z. Here, the result was evaluated as "○" when the viscosity did not increase, as "Δ" when the viscosity increased slightly, and as "X" when a part of the liquid was gelled completely. The results of evaluations are shown in TABLE 7 above.

As shown in TABLE 7 above, in the case where the cobalt concentration was 0.03 g/L or more, the gelation of the liquid was prevented. In the case where the cobalt concentration was 0.05 g/L or more, increase in viscosity was prevented.

<Test 8>

In this test, an influence of water-soluble silicate concentration in a chemical conversion treatment liquid on the stability of a concentrate was investigated.

First, prepared were aqueous solutions 8A to 8K having different silicate concentrations. Here, sodium metasilicate anhydride was used as the silicate. The solutions 8A to 8K were left stand at the ambient temperature for 12 months. The states of the liquids after the passage of 12 months were evaluated by visual observation. The silicon concentrations in the treatment solutions 8A to 8K used herein and the results of evaluations are shown in TABLE 8 below.

TABLE 8

| | Solution | | | | | | | | | | |
|---|---|---|---|---|---|---|---|---|---|---|---|
| | 8A | 8B | 8C | 8D | 8E | 8F | 8G | 8H | 8I | 8J | 8K |
| Si conc. (g/L) | 0.0 | 1.0 | 2.5 | 4.0 | 5.0 | 6.0 | 7.5 | 9.0 | 10.0 | 12.5 | 15.0 |
| Stability | ○ | ○ | ○ | ○ | ○ | ○ | ○ | ○ | Δ | X | X |

In TABLE 8, the symbol "○" represents that no sign pointing to gelation of the liquid, i.e., no increase in viscosity was found. The symbol "Δ" represents that the viscosity of the liquid increased slightly. The symbol "X" represents that a part of the liquid was gelled completely.

As shown in TABLE 8, no gelation was occurred in the case where the silicon concentration was 10 g/L or less and no sign pointing to gelation was found in the case where the silicon concentration was 9 g/L or less. Therefore, for example, in the case where the silicate concentration in the chemical conversion treatment liquid is one-third or less of the silicate concentration in the concentrate, the silicate concentration in the chemical conversion treatment liquid is preferably 3.3 g/L or less, and more preferably 3 g/L or less in terms of stability of the concentrate.

<Test 9>

In this test, an influence of magnesium concentration in a chemical conversion treatment liquid on the appearance and corrosion resistance of a conversion layer was investigated.

First, conversion layers were formed on surfaces of galvanized parts by the same method as that described in Test 1 except that chemical conversion treatment liquids 9A to 9Q were used instead of the chemical conversion treatment liquids 1A to 1T. The compositions of the treatment liquids 9A to 9Q used herein are shown in TABLE 9 below.

TABLE 9

| | Chemical conversion treatment liquid | | | | | | | | |
|---|---|---|---|---|---|---|---|---|---|
| | 9A | 9B | 9C | 9D | 9E | 9F | 9G | 9H | 9I |
| Mg conc. (g/L) | 0.0 | 0.2 | 0.4 | 0.5 | 1.0 | 2.5 | 5.0 | 7.5 | 10.0 |
| Co conc. (g/L) | 1.0 | 1.0 | 1.0 | 1.0 | 1.0 | 1.0 | 1.0 | 1.0 | 1.0 |
| Si conc. (g/L) | 1.5 | 1.5 | 1.5 | 1.5 | 1.5 | 1.5 | 1.5 | 1.5 | 1.5 |
| $NO_3^-$ conc. (g/L) | 7.29 | 7.29 | 7.29 | 7.29 | 7.29 | 7.29 | 7.29 | 7.29 | 7.29 |
| Gross/iridescence | X | Δ | Δ | Δ | Δ | Δ | ○ | ○ | ○ |
| Corrosion resistance | E | D | D | C | C | B | B | B | A |

| | Chemical conversion treatment liquid | | | | | | | |
|---|---|---|---|---|---|---|---|---|
| | 9J | 9K | 9L | 9M | 9N | 9O | 9P | 9Q |
| Mg conc. (g/L) | 15.0 | 20.0 | 25.0 | 30.0 | 35.0 | 38.0 | 40.0 | 45.0 |
| Co conc. (g/L) | 1.0 | 1.0 | 1.0 | 1.0 | 1.0 | 1.0 | 1.0 | 1.0 |
| Si conc. (g/L) | 1.5 | 1.5 | 1.5 | 1.5 | 1.5 | 1.5 | 1.5 | 1.5 |
| $NO_3^-$ conc. (g/L) | 7.29 | 7.29 | 7.29 | 7.29 | 7.29 | 7.29 | 7.29 | 7.29 |
| Gross/iridescence | ○ | ○ | ○ | ○ | ○ | ○ | Δ | X |
| Corrosion resistance | A | B | B | C | C | C | D | E |

The treatment liquid 9A was prepared by mixing sodium nitrate, sodium metasilicate anhydride, cobalt chloride hexahydrate and pure water together. The treatment liquids 9B to 9Q were prepared by mixing magnesium chloride hexahydrate, sodium nitrate, sodium metasilicate anhydride, cobalt chloride hexahydrate and pure water together. Then, appearance and corrosion resistance of each conversion layer thus obtained were evaluated by the same method as that described in Test 1 except that the duration of the salt spray testing was 72 hours. The results of evaluations are summarized in TABLE 9 above.

As shown in TABLE 9 above, in the case where the magnesium concentration fell within a range of 0.2 g/L to 40.0 g/L, sufficient performances were achieved regarding gross and iridescence. In the case where the magnesium concentration fell within a range of 5.0 g/L to 38.0 g/L, excellent performances were achieved regarding gross and iridescence. Note that the cony ion layers obtained using the treatment liquid 9B to 9E were thin in color. Note also that the conversion layer obtained using the treatment liquid 9P exhibited significant color irregularities.

As shown in TABLE 9, in the case where the magnesium concentration fell within a range of 0.5 g/L to 38.0 g/L, a sufficient corrosion resistance was achieved. In the case where the magnesium concentration fell within a range of 2.5 g/L to 25.0 g/L, an excellent corrosion resistance was achieved.

<Test 10>

In this test, an influence of nitrate ion concentration in a chemical conversion treatment liquid on the appearance and corrosion resistance of a conversion layer was investigated.

First, conversion layers were formed on surfaces of galvanized parts by the same method as that described in Test 9 except that chemical conversion treatment liquids 10A to 10V were used instead of the chemical conversion treatment liquids 9A to 9Q. Note that the treatment liquid 10A was prepared by mixing magnesium chloride hexahydrate, sodium metasilicate anhydride, cobalt chloride hexahydrate and pure water together. The treatment liquids 10B to 10V were prepared by mixing magnesium chloride hexahydrate, sodium nitrate, sodium metasilicate anhydride, cobalt chloride hexahydrate and pure water together.

Then, appearance and corrosion resistance of each conversion layer thus obtained were evaluated by the same method as that described in Test 9. The compositions of the treatment liquids 10A to 10V and the results of evaluations are summarized in TABLE 10 below.

TABLE 10

| | Chemical conversion treatment liquid | | | | | | | | | | |
|---|---|---|---|---|---|---|---|---|---|---|---|
| | 10A | 10B | 10C | 10D | 10E | 10F | 10G | 10H | 10I | 10J | 10K |
| Mg conc. (g/L) | 10.0 | 10.0 | 10.0 | 10.0 | 10.0 | 10.0 | 10.0 | 10.0 | 10.0 | 10.0 | 10.0 |
| Co conc. (g/L) | 1.0 | 1.0 | 1.0 | 1.0 | 1.0 | 1.0 | 1.0 | 1.0 | 1.0 | 1.0 | 1.0 |
| Si conc. (g/L) | 1.5 | 1.5 | 1.5 | 1.5 | 1.5 | 1.5 | 1.5 | 1.5 | 1.5 | 1.5 | 1.5 |
| $NO_3^-$ conc. (g/L) | 0.00 | 0.15 | 0.29 | 0.36 | 0.73 | 1.82 | 3.65 | 5.47 | 7.29 | 10.94 | 14.59 |
| Gross/iridescence | X | Δ | Δ | Δ | ○ | ○ | ○ | ○ | ○ | ○ | ○ |
| Corrosion resistance | E | D | D | C | C | B | A | A | A | A | B |

| | Chemical conversion treatment liquid | | | | | | | | | | |
|---|---|---|---|---|---|---|---|---|---|---|---|
| | 110L | 10M | 10N | 10O | 10P | 10Q | 10R | 10S | 10T | 10U | 10V |
| Mg conc. (g/L) | 10.0 | 10.0 | 10.0 | 10.0 | 10.0 | 10.0 | 10.0 | 10.0 | 10.0 | 10.0 | 10.0 |
| Co conc. (g/L) | 1.0 | 1.0 | 1.0 | 1.0 | 1.0 | 1.0 | 1.0 | 1.0 | 1.0 | 1.0 | 1.0 |
| Si conc. (g/L) | 1.5 | 1.5 | 1.5 | 1.5 | 1.5 | 1.5 | 1.5 | 1.5 | 1.5 | 1.5 | 1.5 |
| $NO_3^-$ conc. (g/L) | 21.90 | 29.18 | 36.47 | 51.06 | 72.94 | 87.53 | 109.41 | 131.29 | 145.88 | 218.82 | 364.71 |
| Gross/iridescence | ○ | ○ | ○ | ○ | ○ | ○ | ○ | ○ | ○ | ○ | Δ |
| Corrosion resistance | B | B | B | B | C | C | C | C | C | C | C |

As shown in TABLE 10 above, in the case where the nitrate ion concentration was 0.15 q/L or more, sufficient performances were achieved regarding gross and iridescence the case where tree nitrate concentration fell within a range of 0.73 g/L to 218.02 g/L, excellent performances were achieved regarding gross and iridescence. Note that the conversion layers obtained using the treatment liquid 10B to 10D were thin in color. Note also that the conversion layer obtained using the treatment liquid 10V exhibited slight color irregularities.

As shown in TABLE 10, in the case where the nitrate ion concentration was 0.36 g/L or more, a sufficient corrosion resistance was achieved. In the case where the nitrate ion concentration fell within a range of 1.82 g/L to 51.06 g/L, an excellent corrosion resistance was achieved.

<Test 11>

In this test, an influence of silicon concentration in a chemical conversion treatment liquid on the appearance and corrosion resistance of a conversion layer was investigated.

First, conversion layers were formed on surfaces of galvanized parts by the same method as that described in Test 9 except that chemical conversion treatment liquids 11A to 11R were used instead of the chemical conversion treatment liquids 9A to 9Q. Note that the treatment liquid 11A was prepared by mixing magnesium chloride hexahydrate, sodium nitrate, cobalt chloride hexahydrate and pure water together. The treatment liquids 11B to 11R were prepared by mixing magnesium chloride hexahydrate, sodium nitrate, sodium metasilicate anhydride, cobalt chloride hexahydrate and pure water together.

Then, appearance and corrosion resistance of each conversion layer thus obtained were evaluated by the same method as that described in Test 9. The compositions of the treatment liquids 11A to 11R and the results of evaluations are summarized in TABLE 11 below.

TABLE 11

| | Chemical conversion treatment liquid | | | | | | | | |
|---|---|---|---|---|---|---|---|---|---|
| | 11A | 11B | 11C | 11D | 11E | 11F | 11G | 11H | 11I |
| Mg conc. (g/L) | 10.0 | 10.0 | 10.0 | 10.0 | 10.0 | 10.0 | 10.0 | 10.0 | 10.0 |
| Co conc. (g/L) | 1.0 | 1.0 | 1.0 | 1.0 | 1.0 | 1.0 | 1.0 | 1.0 | 1.0 |
| Si conc. (g/L) | 0.0 | 0.2 | 0.4 | 0.5 | 0.6 | 0.8 | 1.0 | 1.2 | 1.5 |
| $NO_3^-$ conc. (g/L) | 7.29 | 7.29 | 7.29 | 7.29 | 7.29 | 7.29 | 7.29 | 7.29 | 7.29 |
| Gross/iridescence | X | X | Δ | Δ | ○ | ○ | ○ | ○ | ○ |
| Corrosion resistance | E | D | D | C | C | C | B | B | A |

| | Chemical conversion treatment liquid | | | | | | | | |
|---|---|---|---|---|---|---|---|---|---|
| | 11J | 11K | 11L | 11M | 11N | 11O | 11P | 11Q | 11R |
| Mg conc. (g/L) | 10.0 | 10.0 | 10.0 | 10.0 | 10.0 | 10.0 | 10.0 | 10.0 | 10.0 |
| Co conc. (g/L) | 1.0 | 1.0 | 1.0 | 1.0 | 1.0 | 1.0 | 1.0 | 1.0 | 1.0 |
| Si conc. (g/L) | 1.6 | 1.7 | 1.8 | 2.0 | 2.5 | 3.0 | 3.5 | 4.0 | 5.0 |
| $NO_3^-$ conc. (g/L) | 7.29 | 7.29 | 7.29 | 7.29 | 7.29 | 7.29 | 7.29 | 7.29 | 7.29 |
| Gross/iridescence | ○ | ○ | ○ | ○ | ○ | ○ | Δ | X | X |
| Corrosion resistance | B | C | C | C | C | D | D | E | E |

As shown in TABLE 11 above, in the case where the silicon concentration fell within a range of 0.4 g/L to 3.5 g/L, sufficient performances were achieved regarding gross and iridescence. In the case where the silicon concentration fell within a range of 0.6 g/L to 3.0 g/L, excellent performances were achieved regarding gross and iridescence.

As shown in TABLE 11, in the case where the silicon concentration fell within a range of 0.5 g/L to 2.5 g/L, a sufficient corrosion resistance was achieved. In the case where the silicon concentration fell within a range of 1.0 g/L to 1.6 g/L, an excellent corrosion resistance was achieved.

<Test 12>

In this test, an influence of silicon concentration in a chemical conversion treatment liquid on the structure of a conversion layer was investigated.

First, prepared was the same chemical conversion treatment liquid as the treating liquid 9J except that the silicon concentration was 3 g/L. Hereinafter, this chemical conversion treatment liquid will be referred to as "chemical conversion treatment liquid 9R". Then, a conversion layer was formed on a surface of galvanized part by the same method as that described previously except that chemical conversion treatment liquid 9R was used. An image of the conversion layer thus obtained and an image of the conversion layer obtained using the treatment liquid 9J were taken using a scanning electron microscope.

Figure 2:
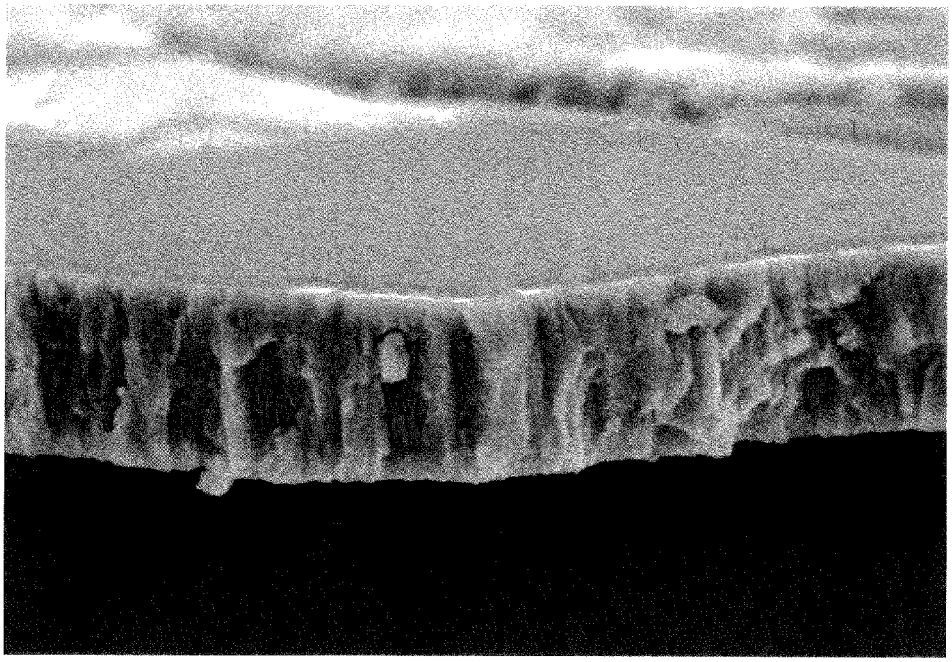
FIG. 2 is a microphotograph of another conversion layer.

FIG. 1 is a microphotograph of the conversion layer obtained using the treatment liquid 9R. FIG. 2 is a microphotograph of the conversion layer obtained using the treatment liquid 9J.

In the case where the magnesium concentration in a chemical conversion treatment liquid is relatively high, when the silicon concentration in the chemical conversion treatment liquid is increased, there is a tendency that a conversion layer having cracks therein is obtained as shown in FIG. 1. By contrast, when the silicon concentration in the chemical conversion treatment liquid is decreased, a dense conversion layer as shown in FIG. 2 is obtained even in the case where the magnesium concentration in a chemical conversion treatment liquid is relatively high.

<Test 13>

In this test, an influence of cobalt concentration in a chemical conversion treatment liquid on the appearance and corrosion resistance of a conversion layer was investigated.

First, conversion layers were formed on surfaces of galvanized parts by the same method as that described in Test 9 except that chemical conversion treatment liquids 12A to 12P were used instead of the chemical conversion treatment liquids 9A to 9Q. Note that the treatment liquid 12A was prepared by mixing magnesium chloride hexahydrate, sodium nitrate, sodium metasilicate anhydride and pure water together. The treatment liquids 12B to 12P were prepared by mixing magnesium chloride hexahydrate, sodium nitrate, sodium metasilicate anhydride, cobalt chloride hexahydrate and pure water together.

Then, appearance and corrosion resistance of each conversion layer thus obtained were evaluated by the same method as that described in Test 9. The compositions of the treatment liquids 12A to 12P and the results of evaluations are summarized in TABLE 12 below.

TABLE 12

| | Chemical conversion treatment liquid | | | | | | | |
|---|---|---|---|---|---|---|---|---|
| | 12A | 12B | 12C | 12D | 12E | 12F | 12G | 12H |
| Mg conc. (g/L) | 10.0 | 10.0 | 10.0 | 10.0 | 10.0 | 10.0 | 10.0 | 10.0 |
| Co conc. (g/L) | 0.00 | 0.05 | 0.10 | 0.20 | 0.40 | 0.60 | 0.80 | 1.00 |
| Si conc. (g/L) | 1.5 | 1.5 | 1.5 | 1.5 | 1.5 | 1.5 | 1.5 | 1.5 |
| $NO_3^-$ conc. (g/L) | 7.29 | 7.29 | 7.29 | 7.29 | 7.29 | 7.29 | 7.29 | 7.29 |
| Gross/ iridescence | ○ | ○ | ○ | ○ | ○ | ○ | ○ | ○ |
| Corrosion resistance | C | B | B | B | B | B | A | A |

| | Chemical conversion treatment liquid | | | | | | | |
|---|---|---|---|---|---|---|---|---|
| | 12I | 12J | 12K | 12L | 12M | 12N | 12O | 12P |
| Mg conc. (g/L) | 10.0 | 10.0 | 10.0 | 10.0 | 10.0 | 10.0 | 10.0 | 10.0 |
| Co conc. (g/L) | 1.25 | 1.50 | 2.00 | 3.00 | 3.25 | 3.50 | 3.75 | 4.00 |
| Si conc. (g/L) | 1.5 | 1.5 | 1.5 | 1.5 | 1.5 | 1.5 | 1.5 | 1.5 |
| $NO_3^-$ conc. (g/L) | 7.29 | 7.29 | 7.29 | 7.29 | 7.29 | 7.29 | 7.29 | 7.29 |
| Gross/ iridescence | ○ | ○ | ○ | ○ | ○ | Δ | Δ | X |
| Corrosion resistance | B | B | C | C | C | D | D | E |

As shown in TABLE 12 above, in the case where the cobalt concentration was 3.75 g/L or less, sufficient performances were achieved regarding gross and iridescence. In the case where the cobalt concentration was 3.25 q/5 or less, excellent performances were achieved regarding gross and iridescence.

As shown in TABLE 12, in the case where the cobalt concentration was 3.25 g/L or less, a sufficient corrosion resistance was achieved. In the case where the cobalt concentration fell within a range of 0.05 g/L to 1.5 g/L, an excellent corrosion resistance was achieved.

<Test 14>

In this test, an influence of aluminum concentration in a chemical conversion treatment liquid on the appearance and corrosion resistance of a conversion layer was investigated.

First, conversion layers were formed on surfaces of galvanized parts by the same method as that described in Test 9 except that chemical conversion treatment liquids 13A to 13P were used instead of the chemical conversion treatment liquids 9A to 9Q. Note that each of the treatment liquids 13A to 13P contained aluminum as shown in TABLE 13 below. Here, aluminum nitrate nonahydrate was used as the aluminum source.

Then, appearance and corrosion resistance of each conversion layer thus obtained were evaluated by the same method as that described in Test 9 except that the duration of the salt spray test, was 24 hours.

Regarding blooming, the result was evaluated as "○" when no bloom appeared on the surface, as "Δ" when an area ratio of bloom appeared on the galvanized part to the total area of the part was more than 0% and equal to or less than 50%, and as "X" when the area ratio was more than 50%.

The compositions of the treatment liquids 13A to 13P and the results of evaluations are summarized in TABLE 13 below.

TABLE 13

| | Chemical conversion treatment liquid | | | | | | | |
|---|---|---|---|---|---|---|---|---|
| | 13A | 13B | 13C | 13D | 13E | 13F | 13G | 13H |
| Mg conc. (g/L) | 10.0 | 10.0 | 10.0 | 10.0 | 10.0 | 10.0 | 10.0 | 10.0 |
| Co conc. (g/L) | 1.0 | 1.0 | 1.0 | 1.0 | 1.0 | 1.0 | 1.0 | 1.0 |
| Si conc. (g/L) | 1.5 | 1.5 | 1.5 | 1.5 | 1.5 | 1.5 | 1.5 | 1.5 |
| $NO_3^-$ conc. (g/L) | 7.29 | 7.29 | 7.29 | 7.99 | 7.29 | 7.29 | 7.29 | 7.29 |
| Al conc. (g/L) | 0.01 | 0.03 | 0.05 | 0.08 | 0.10 | 0.20 | 0.40 | 0.50 |
| Gross/ iridescence | ○ | ○ | ○ | ○ | Δ | Δ | Δ | X |
| Blooming | ○ | ○ | Δ | Δ | X | X | X | X |
| Corrosion resistance | B | C | C | C | D | D | D | E |

| | Chemical conversion treatment liquid | | | | | | | |
|---|---|---|---|---|---|---|---|---|
| | 13I | 13J | 13K | 13L | 13M | 13N | 13O | 13P |
| Mg conc. (g/L) | 10.0 | 10.0 | 10.0 | 10.0 | 10.0 | 10.0 | 10.0 | 10.0 |
| Co conc. (g/L) | 1.0 | 1.0 | 1.0 | 1.0 | 1.0 | 1.0 | 1.0 | 1.0 |
| Si conc. (g/L) | 1.5 | 1.5 | 1.5 | 1.5 | 1.5 | 1.5 | 1.5 | 1.5 |
| $NO_3^-$ conc. (g/L) | 7.29 | 7.29 | 7.29 | 7.29 | 7.29 | 7.29 | 7.29 | 7.29 |
| Al conc. (g/L) | 1.00 | 1.60 | 1.90 | 2.00 | 2.50 | 3.00 | 3.40 | 5.00 |
| Gross/ iridescence | X | X | X | X | X | X | X | X |
| Blooming | X | X | X | X | X | X | X | X |
| Corrosion resistance | E | E | E | E | E | E | E | E |

As shown in TABLE 13 above, in the case where the aluminum concentration was 0.50 g/L or more, sufficient performances were not achieved regarding gross and iridescence. In the case where the aluminum concentration was 0.10 g/L or more, a sufficient performance was not achieved regarding corrosion resistance and bloom appeared.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. A chemical conversion treatment liquid for forming a conversion layer on zinc or a zinc alloy, the liquid being free of chromium, hydrogen peroxide and fluorine, and comprising 0.5 g/L to 38 g/L of magnesium, 0.5 g/L to 3.5 g/L of silicon, and 0.36 g/L or more of nitrate ion, the liquid containing the silicon as a water-soluble silicate, and optionally further comprising cobalt at a concentration of 5 g/L or less, and an aluminum content, thereof being 0.08 g/L or less.

2. The chemical conversion treatment liquid according to claim 1, wherein the liquid contains 0.5 g/L to 2.5 g/L of silicon as the water-soluble silicate and the concentration of cobalt is 3.25 g/L or less.

3. The chemical conversion treatment liquid according to claim 2, wherein a concentration of magnesium falls within a range of 2.5 g/L to 25 g/L, the concentration of cobalt falls within a range of 0.05 g/L to 1.5 g/L, a concentration of silicon fails within a range of 1 g/L to 1.6 g/L, and a concentration of nitrate ion falls within a range of 1.8 g/L to 51 g/L.

4. The chemical conversion treatment liquid according to claim 1, wherein the liquid contains 0.7 g/L to 3.5 g/L of silicon as the water-soluble silicate, a concentration of magnesium falls within a range of 1 g/L to 12 g/L, the concentration of cobalt falls within a range of 0.03 g/L to 5 g/L, a concentration of nitrate ion falls within a range of 3 g/L to 15 and the aluminum content is 0.01 g/L or less.

5. The chemical conversion treatment liquid according to claim 4, wherein the concentration of cobalt falls within a range of 0.05 g/L to 5 g/L.

6. The chemical conversion treatment liquid according to claim 4, wherein the concentration of magnesium falls within a range of 1.8 g/L to 5 g/L, the concentration of cobalt falls within a range of 0.05 g/L to 2 g/L, a concentration of silicon falls within a range of 1.2 g/L to 3 g/L, the concentration of nitrate ion falls within a range of 4.5 g/L to 11 g/L.

7. A method of producing a chemical conversion treatment liquid, comprising mixing first and second concentrates and optionally water together to obtain the chemical conversion treatment liquid according to claim 1, the first concentrate containing magnesium and nitrate ion at higher concentrations than those in the second concentrate, and the second concentrate containing water-soluble silicate at a higher concentration than that in the first concentrate.

8. The method according to claim 7, wherein the liquid contains 0.5 g/L to 2.5 g/L of silicon as the water-soluble silicate and the concentration of cobalt is 3.25 g/L or less.

9. The method according to claim 7 wherein a concentration of magnesium falls within a range of 2.5 g/L to 25 g/L, the concentration of cobalt falls within a range of 0.05 g/L to 1.5 g/L, a concentration of silicon falls within a range of 1 g/L to 1.6 g/L, and a concentration of nitrate ion falls within a range of 1.8 g/L to 51 g/L.

10. The method according to claim 7, wherein the liquid contains 0.7 g/L to 3.5 g/L of silicon as the water-soluble silicate, a concentration of magnesium falls within a range of 1 g/L to 12 g/L, the concentration of cobalt falls within a range of 0.03 g/L to 5 g/L, a concentration of nitrate ion falls within a range of 3 g/L to 15 g/L, and the aluminum content is 0.01 g/L or less.

11. The method according to claim 10, wherein the concentration of cobalt is 0.05 g/L or more.

12. The method according to claim 10, wherein the concentration of magnesium falls within a range of 1.8 g/L to 5 g/L, the concentration of cobalt falls within a range of 0.05 g/L to 2 g/L, a concentration of silicon falls within a range of 1.2 g/L to 3 g/L, and the concentration of nitrate ion falls within a range 4.5 g/L to 11 g/L.

13. A method of forming a conversion layer, comprising subjecting zinc or a zinc alloy to a chemical conversion treatment using the chemical conversion treatment liquid according to claim 1.

14. The method according to claim 13, wherein the liquid contains 0.5 g/L to 2.5 g/L of silicon as the water-soluble silicate and the concentration of cobalt is 3.25 g/L or less.

15. The method according to claim 14, wherein a concentration of magnesium fails within a range of 2.5 g/L to 25 g/L, the concentration of cobalt falls within a range of 0.05 g/L to 1.5 g/L, a concentration of silicon falls within a range of 1 g/L to 1.6 g/L, and a concentration of nitrate ion falls within a range of 1.8 g/L to 51 g/L.

16. The method according to claim 13, wherein the liquid contains 0.7 g/L to 3.5 g/L of silicon as the water-soluble silicate, a concentration of magnesium falls within a range of 1 g/L to 12 g/L, the concentration of cobalt falls within a range of 0.03 g/L to 15 g/L, a concentration of nitrate ion falls within a range of 3 g/L to 15 g/L, and the aluminum content is 0.01 g/L or less.

17. The method according to claim 16, wherein the concentration of cobalt is 0.05 g/L or more.

18. The method according to claim 16, wherein the concentration of magnesium fall within a range of 1.8 g/L to 5 g/L, the concentration of cobalt falls within a range of 0.05 g/L to 2 g/L, a concentration of silicon falls within a range of 1.2 g/L to 3 g/L, and the concentration of nitrate ion falls within a range of 4.5 g/L to 11 g/L.

* * * * *